United States Patent [19]

Huppert

[11] Patent Number: 4,563,839

[45] Date of Patent: Jan. 14, 1986

[54] FLAP WHEEL

[75] Inventor: James C. Huppert, St. Croix, Wis.

[73] Assignee: Minnesota Mining and Manufacturing Company, Saint Paul, Minn.

[21] Appl. No.: 724,486

[22] Filed: Apr. 18, 1985

Related U.S. Application Data

[63] Continuation of Ser. No. 516,292, Jul. 22, 1983, abandoned.

[51] Int. Cl.[4] ..... B24D 13/04

[52] U.S. Cl. ..... 51/334; 51/337; 15/198; 15/230.16

[58] Field of Search ..... 51/330, 331, 332, 334, 51/335, 336, 337; 15/198, 200, 230.14, 230.16

[56] References Cited

U.S. PATENT DOCUMENTS

| | | | |
|---|---|---|---|
| 2,516,870 | 8/1950 | Harrison | 51/334 |
| 2,549,043 | 4/1951 | Arthur | 51/334 |
| 3,058,269 | 8/1962 | Block | 51/334 |
| 3,512,311 | 5/1970 | Block | 51/334 |
| 3,645,049 | 2/1972 | Freerks et al. | 51/334 |
| 3,648,417 | 3/1972 | Block | 51/334 |
| 3,653,856 | 4/1972 | Field | 51/334 |
| 3,879,903 | 4/1975 | Belanger | 51/337 |
| 4,080,714 | 3/1978 | Emerson | 51/334 X |
| 4,183,183 | 1/1980 | Belanger | 51/334 |
| 4,217,737 | 8/1980 | Hasegawa | 51/334 |

*Primary Examiner*—Robert P. Olszewski

*Attorney, Agent, or Firm*—Donald M. Sell; James A. Smith; William L. Huebsch

[57] ABSTRACT

An abrasive flap wheel assembly including abrasive packets having their inner end portions disposed in recesses in the hub and being attached so that they project at about a right angle to a radius of the hub through the area of attachment between the hub and the abrasive packet to provide a small assembly that facilitates contact between a large portion of the major outer abrasive faces of the packets. Also the outer ends of the pieces of abrasive-coated material in the packets are spaced to provide exposed abrasive-coated end portions for the underlying pieces of abrasive-coated material in the packets.

2 Claims, 5 Drawing Figures

FLAP WHEEL

This is a continuation of application Ser. No. 516,292 filed July 2, 1983, now abandoned.

TECHNICAL FIELD

This invention relates generally to flap wheel assemblies of the type used to abrade flat or arcuate surfaces.

BACKGROUND ART

U.S. Pat. No. 3,645,049 (incorporated herein by reference) describes a flap wheel assembly of a type commonly used to abrade surfaces which includes a hub including means for affording attachment of the hub to a source of power to rotate the hub in a first direction about an axis. The hub has a plurality of similarly shaped slots which extend generally longitudinally of the hub, are spaced about its axis and open through the periphery of the hub. Each of the slots is generally keyhole-shaped in cross section, having a narrow portion adjacent the hub's periphery, and an enlarged inner portion spaced from the hub's periphery by its narrow portion. Also included in the flap wheel assembly are a plurality of tablet-like abrasive packets each comprising a plurality of pieces of abrasive-coated sheet material disposed face-to-back with first edges generally aligned to provide one major abrasive-coated face for the abrasive packet. A sheet of tough flexible attachment material has end portions projecting between the pieces from their first edges and fastened between the pieces by means adjacent the first edges that fasten the pieces of abrasive-coated sheet material together. A generally U-shaped bight portion of the sheet of attaching material for each abrasive packet projects from the first edges of its pieces of abrasive-coated sheet material, is inserted in a different one of the slots of the hub, and has a rod within its part in the inner portion of the slot to attach the abrasive packet to the hub.

While the flap wheel assembly described in U.S. Pat. No. 3,645,049 is quite serviceable for abrading outer planar or convex surfaces, the abrasive packets are closely spaced about the periphery of the hub so that they project generally radially of the hub and the sheets of abrasive-coated sheet material in each pocket have aligned outer edges which results in abrading action being provided only by narrow outer edge portions of the pieces of abrasive-coated sheet material in each abrasive packet.

Less closely spaced packets have been used around the periphery of a similar hub to allow the abrasive-coated face of the packet to have more surface contact with surfaces being abraded. This approach, however, has still not provided the long scratch pattern that is often desired when surfaces are being abraded.

Also the flap wheel assembly has a relatively large diameter that limits its usefulness for abrading the inner surfaces of small tubes.

DISCLOSURE OF INVENTION

The present invention provides both an improved abrasive packet design that affords engagement of wider outer edge portions of all the pieces of abrasive-coated sheet material in the abrasive packet with a convex, planar, or concave surface being abraded to provide a desired longer scratch pattern from the abrasive packet; and an improved hub design which, when the hub and abrasive packets are used together as an abrasive wheel assembly, allows the abraive wheel assembly to effectively abrade relatively small cylindrical inner surfaces of tubes.

In the improved abrasive packet according to the present invention at least some, and preferably each, of the pieces of abrasive-coated sheet material in the abrasive packet have outer edges opposite their first inner edges adjacent which the abrasive packet is adapted to be attached to the hub, which outer edges project at least 1/16 inch or 0.16 centimeter past the outer edge of the pieces of abrasive-coated sheet material overlying its abrasive-coated face. This provides exposed abrasive coated portions of the pieces adjacent their outer edges that have been found to produce a more desirable long scratch pattern on surfaces abraded by the abrasive packet.

The improved hub has a plurality of longitudinally extending recesses each defined in part by a trailing surface when the hub is rotated in a first direction. Means are provided for attaching each of the abrasive packets to the hub to position its first surface adjacent the trailing surface of a different one of the recesses with the pieces of abrasive coated material in the abrasive packet disposed at about a right angle with respect to a radius of the hub through the area of attachment between the hub and the abrasive packet. The recesses are shaped to provide clearance for the rather inflexible portions of the abrasive packets adjacent the first edges of the pieces of abrasive sheet material through which they are fastened together. The orientation of the abrasive packets affords curving of the distal portions of the pieces of coated abrasive sheet material around the hub and contact between a large portion of the major abrasive-coated faces of the abrasive packets to facilitate abrading a cylindrical inner surface within which the flap wheel is rotated. When this improved hub is used with improved abrasive packets of the type described above, this outer major abrasive-coated face of each abrasive packet will include substantial end portions of underlying pieces of abrasive-coated sheet material in the packet that will further improve the scratch pattern.

Preferably the hub has from 2 to 4 recesses and carries from 2 to 4 abrasive packets equally spaced about its periphery. Hubs having two notches and carrying two abrasive packets provide a minimum size flap wheel assembly that is very useful for abraiding the cylindrical inner surface for relatively small tubes (e.g., as small as 1½ inch or 3.8 centimeter inside diameter tubes).

BRIEF DESCRIPTION OF DRAWING

The present invention will be further described with reference to the accompanying drawing wherein like numbers refer to like parts in the several views, and wherein.

DETAILED DESCRIPTION

Figure 2:
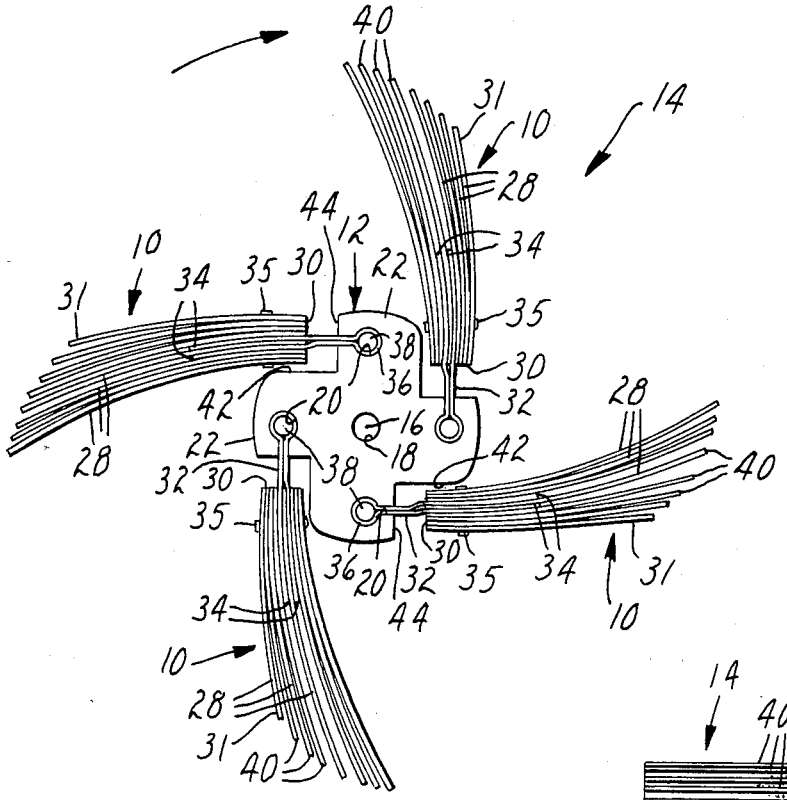
FIG. 2 shows a first embodiment of a flap wheel assembly including four abrasive packets of the type shown in FIG. 1 and an improved hub according to the present invention.
Figure 1:
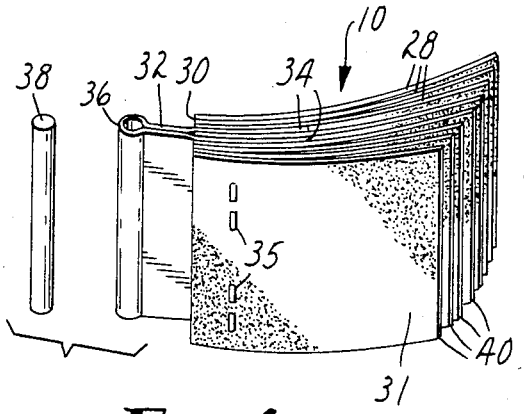
FIG. 1 shows a view in perspective of an improved abrasive pocket according to the present invention.
Figure 3:
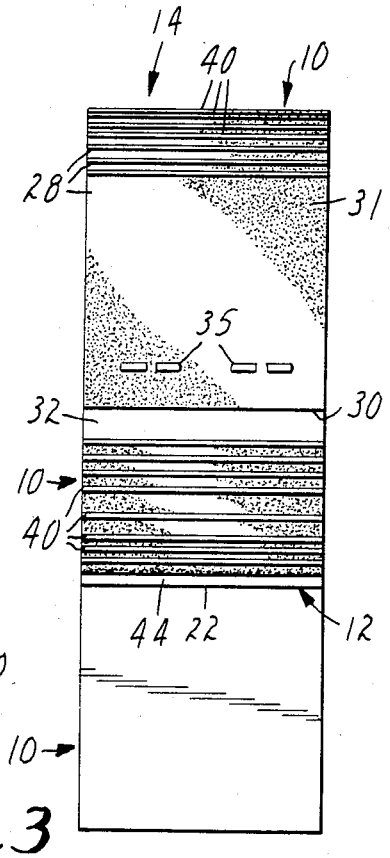
FIG. 3 shows a top view of the flap wheel assembly shown in FIG. 1.

Referring now to the drawing, there is shown in FIG. 1 an improved abrasive packet 10 according to the present invention; and there is shown in FIGS. 2 and 3 four abrasive packets 10 of the type shown in FIG. 1 incorporated with one embodiment of a hub 12 according to the present invention to provide an abrasive flap wheel assembly 14.

Generally, like prior art abrasive flap wheel assemblies described in U.S. Pat. No. 3,645,049, the hub 12 has an axis 16, means in the form of a threaded opening 18 around the axis 16 for affording attachment of the hub 12 to a source of power to rotate the hub 12 in a first direction indicated by an arrow in FIG. 2, and a plurality of similarly shaped slots 20 extending axially of the hub 12 and generally parallel to the axis 16, equally spaced about the axis 16, and opening through a periphery 22 of the hub 12. Each of the slots 20 is generally keyhole-shaped in cross section, including a narrow outer portion adjacent the periphery 22 of the hub 12, and an enlarged cylindrical inner portion spaced from the periphery 22 by the outer portion of the slot 20. Each abrasive packet 10 is a tablet-like structure comprising a plurality of pieces 28 of abrasive-coated sheet material of a similar width and disposed face-(the abrasive coated side) to-back (the non-abrasive coated side) with first edges 30 and side edges generally aligned and with the abrasive coatings of the pieces 28 on corresponding faces thereof which includes the outer face 31 of the outer piece 28 of abrasive-coated sheet material. This outer face 31, together with the distal end portions of the underlying pieces 28, can be drawn across a contacted surface to abrade it when the flap wheel assembly 14 is rotated in the first indicated direction. Each abrasive packet 10 also comprises a sheet of tough flexible attachment material 32 having opposite end portions 34 projecting between the pieces of abrasive-coated sheet material 28 from their first edges 30 and fastened therein by staples 35 that provide means for fastening the pieces 28 of abrasive-coated sheet material together adjacent their first edges 30. The sheets of attachment material 32, the slots 20, and rods 38 provide means for attaching the abrasive packets 10 to the hub 13. Generally U-shaped bight portions 36 of the sheets of attachment material 32 project from the first edges 30 of the abrasive packets 10. The bight portion 36 of the sheet of attachment material 32 for each of the abrasive packets 10 is positioned in a different one of the slots 20, and is held in that slot 20 by one of the rods 38 within the bight portion 36 and the inner portion of the slot 20.

The novelty in the improved abrasive packet 10 with respect to the abrasive packets described in U.S. Pat. No. 3,645,049 is that some, and as illustrated, all of the pieces 28 of abrasive-coated sheet material in the abrasive packets 10 have outer edges 40 opposite their first inner edges 30 that project at least 1/16 inch or 0.16 centimeter, and up to about ⅜ inch or 1 centimeter, past the outer edges 40 of the pieces 28 of abrasive-coated sheet material overlying their abrasive-coated faces. This provides exposed abrasive-coated portions of those underlying pieces 28 adjacent their outer edges 40.

The novelty in the hub 12 with respect to the hub described in U.S. Pat. No. 3,645,049 is that the hub 12 has a plurality of longitudinally extending generally L-shaped recesses 42 each defined in part by a trailing surface 44 when the hub 12 is rotated in the first direction indicated by the arrow in FIG. 2, and a different one of the slots 20 opens through each of the trailing surfaces 44 with the slot 20 being disposed at about a right angle with a radius of the hub 12 through the enlarged inner portion of the slot 20. The recesses 42 provide clearance for the relatively inflexible portions of the abrasive packets 10 adjacent the generally aligned edges 30 of the pieces 28 of abrasive-coated material through which they are fastened by the staples 35, and the orientation of the slots 20 and the sheets of attachment material 32 (which provide the means for attaching the abrasive packets 10 to the hub 12 to position the first edges 30 of the abrasive packets 10 adjacent the trailing surface 44) disposes the pieces 28 of abrasive coated material in each abrasive packet 10 at about a right angle with respect to a radius of the hub 12 through its area of attachment. This affords contact between a large portion of the outer face 31 of the outer piece 28 of coated-abrasive sheet material in each of the abrasive packets 10 together with the end portions of the underlying pieces 28 of abrasive-coated sheet material to facilitate abrading an inner cylindrical surface within which the flap wheel assembly 14 is rotated.

Figure 4:
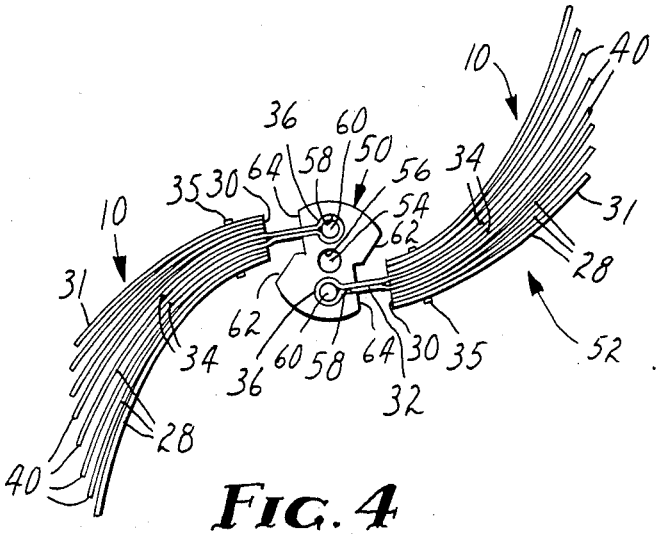
FIG. 4 shows a second embodiment of a flap wheel assembly including two abrasive packets of the type shown in FIG. 1 and a second embodiment of the hub according to the present invention.
Figure 5:
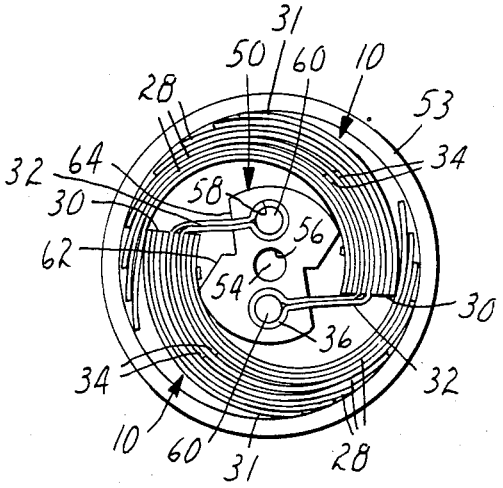
FIG. 5 shows the flap wheel assembly of FIG. 4 in position to abrade the inner cylindrical surface of a tube.

Referring now to FIGS. 4 and 5 there is shown a second embodiment of a hub according to the present invention, generally designated by the reference numeral 50. When the hub 50 is used with two of the abrasive packets 10 to form a flap wheel assembly 52, the flap wheel assembly 52 is particularly useful for abrading small diameter inner cylindrical surfaces (e.g., as small as 1½ inch or 3.8 centimeter diameter) such as that of a tube 53 within which the flap wheel assembly 52 is shown positioned in FIG. 5.

Generally, like the prior art flap wheel assemblies described in U.S. Pat. No. 3,645,049, the hub 50 has an axis 54, means in the form of a threaded opening 56 around the axis 54 for affording attachment of the hub 50 to a source of power to rotate the hub 50 in a first direction indicated by an arrow in FIG. 4, and a plurality of similarly shaped slots 58 extending axially of and generally parallel to the axis 54, spaced about the axis 54, and opening through a periphery of the hub 50. Each of the slots 58 has a keyhole-like cross sectional shape similar to the shape of the slots 20, including a narrow outer portion adjacent the periphery of the hub 50, and an enlarged cylindrical inner portion spaced from the periphery by the outer portion. The bight portions 36 of the sheets of attachment material 32 for the two abrasive packets 10 are each positioned in a different one of the two slots 58, and are held in the slots 58 by a rods 60 within the bight portions 36 and the inner portions of the slots 58.

Like the hub 12, the novelty in the hub 50 with respect to the hub described in U.S. Pat. No. 3,645,049 is that the hub 50 has a plurality of longitudinally extending recesses 62 each defining a trailing surface 64 when the hub 50 is rotated in the first direction indicated by the arrow in FIG. 4, and a different one of the slots 58 opens through each of the trailing surfaces 64 with the slot 58 being disposed at about a right angle with a radius of the hub 50 through the enlarged inner portion of the slot 58. The recesses 62 provide clearance for the portions of the abrasive packets 10 adjacent the aligned edges 30 of the pieces 28 of abrasive-coated material and the orientation of the slots 58 afford contact between a large portion of the outer faces 31 of the outer pieces 28 of abrasive-coated sheet material in the abrasive packets 10 together with the end portions of the underlying pieces 28 of abrasive-coated sheet material to facilitate abrading an inner cylindrical surface within which the flap wheel assembly 52 is rotated.

The abrasive packet and the hub according to the present invention have now been described with reference to one embodiment of the abrasive packet and two embodiments of the hub. It will be appreciated by those skilled in the art that many changes could be made in the illustrated embodiments without departing from the spirit of the present invention. For example, the first edges 30 of the pieces 28 of abrasive-coated sheet material in each abrasive packet 10 need not be as precisely aligned as illustrated. The pieces 28 of coated-abrasive sheet material in one abrasive packet could all be about the same length which would facilitate production, and thus the first inner edges 20 would be spaced like the outer edges 40 to produce an abrasive packet 10 according to the present invention. The words "generally aligned" include this possibility for the first edges 30. Prior art abrasive packets with aligned outer edges can be used on the novel hubs 12 and 50 described herein or on similar hubs within the scope of the claims. The means for attaching the abrasive pockets to the hubs need not be the preferred means illustrated, but could include many other means such as known means used commercially or described in the prior art (see U.S. Pat. No. 3,058,269). Also the means for fastening the pieces of abrasive-coated material together along their first edges in each abrasive packet and the means for fastening that abrasive packet to the hub could be the same structure, such as a clamp at the periphery of the hub. Thus the scope of this invention should not be limited to the illustrated structures, but only by the structures described by the dependent claims and their equivalents.

I claim:

1. In a abrasive flap wheel assembly comprising:

a hub having an axis, including means for affording attachment of the hub to a source of power to rotate the hub in a first direction of rotation about said axis, having a periphery about said axis, and having a plurality of similarly shaped slots parallel to said axis and spaced about said axis, each of said slots opening through said periphery, having a narrow portion adjacent said periphery and an enlarged inner portion spaced from said periphery by said narrow portion;

a plurality of abrasive packets, each abrasive packet comprising a plurality of pieces of abrasive-coated sheet material disposed face-to-back with first edges generally aligned and with the abrasive coatings of said pieces on corresponding faces thereof, a sheet of tough flexible attachment material having opposite end portions projecting between the pieces from said first edges with a generally U-shaped bight portion of said sheet of attachment material projecting from said first edges, and means for attaching said pieces of abrasive-coated sheet material and said sheet of attachment material together along said first edges, the generally U-shaped portion of each of said abrasive packets being inserted in a different one of the slots in said hub, and said abrasive packets each further including a rod within its U-shaped portion and the enlarged portion of said slot to attach said abrasive packet to said hub, the improvement wherein:

said hub has a plurality of longitudinally extending recesses each defined in part by a trailing surface when said hub is rotated in said first direction, and a different one of said slots opens through each of said trailing surfaces with said slot being disposed at about a right angle with a radius of said hub through the enlarged portion of said slot, said recesses being sufficiently large to provide clearance for the portions of said abrasive packets adjacent said first edges and the sheet of tough flexible attachment material for each abrasive packet being sufficiently long to afford bending of the sheet of tough flexible attachment material at about a right angle at the first edge of each abrasive packet and positioning of the entire lengths of the sheets of coated abrasive for each abrasive packet at about a right angle to a radius of said hub to afford a compact assembly with contact between a large portion of the outer faces of the outer piece of coated-abrasive sheet material in each of said abrasive packets and an inner cylindrical surface within which said flap wheel assembly is rotated in said first direction.

2. An abrasive flap wheel assembly according to claim 1 wherein said hub assembly has in the range of 2 to 4 recesses and abrasive packets.

* * * * *